US009726359B1

(12) United States Patent
Jensen et al.

(10) Patent No.: US 9,726,359 B1
(45) Date of Patent: Aug. 8, 2017

(54) LIGHT FIXTURE INCLUDING ADJUSTABLE MOTION SENSOR WITH RECTANGULAR COVERAGE PATTERN

(71) Applicant: Palm Coast Imports, LLC, Germantown, TN (US)

(72) Inventors: Bradford Brian Jensen, Saint Joseph, MI (US); Kim Irwin McCavit, Saint Joseph, MI (US)

(73) Assignee: HKC-US, LLC, Memphis, TN (US)

( * ) Notice: Subject to any disclaimer, the term of this patent is extended or adjusted under 35 U.S.C. 154(b) by 137 days.

(21) Appl. No.: 14/627,668

(22) Filed: Feb. 20, 2015

Related U.S. Application Data

(60) Provisional application No. 61/945,528, filed on Feb. 27, 2014.

(51) Int. Cl.

| | |
|---|---|
| ***F21V 21/02*** | (2006.01) |
| ***F21V 23/04*** | (2006.01) |
| ***F21S 8/00*** | (2006.01) |
| *F21W 131/107* | (2006.01) |

(52) U.S. Cl.
CPC ..... *F21V 23/0471* (2013.01); *F21S 8/03* (2013.01); *F21W 2131/107* (2013.01)

(58) Field of Classification Search
CPC ..... F21V 23/0471; F21S 8/03
USPC ..... 340/555–557; 362/276
See application file for complete search history.

(56) References Cited

U.S. PATENT DOCUMENTS

| | | | |
|---|---|---|---|
| 5,434,764 | A | 7/1995 | Lee et al. |
| 5,590,953 | A | 1/1997 | Haslam et al. |
| 5,626,417 | A | 5/1997 | McCavit |
| 6,323,488 | B1 | 11/2001 | McCavit et al. |
| 6,348,691 | B1 | 2/2002 | Sandell et al. |
| 6,943,687 | B2 | 9/2005 | Lee et al. |
| 7,488,941 | B2 | 2/2009 | Lee et al. |

(Continued)

FOREIGN PATENT DOCUMENTS

| | | |
|---|---|---|
| CA | 2171153 | 10/1996 |
| CA | 2313366 | 3/2001 |

OTHER PUBLICATIONS

Heath Ceiling Mount Occupancy Sensor, LC-400, Heath Commercial, 1992, 2pages.

(Continued)

*Primary Examiner* — Sean Gramling
*Assistant Examiner* — Gerald J Sufleta, II
(74) *Attorney, Agent, or Firm* — Brian S. Steinberger; Law Offices of Brian S. Steinberger, P.A.

(57) ABSTRACT

Systems, devices, and methods for a decorative outdoor light fixture that can include an adjustable motion sensor with a rectangular coverage pattern. An adjustable motion sensor for a light fixture can include an outer housing connected to a light fixture frame, a movable sensor assembly including a motion detector contained within the outer housing, a lens covering a portion of the outer housing in the path of the motion detector sensing beams to direct the sensing beams in a rectangular coverage pattern, and a sensor adjustment mechanism accessible from an exterior of the outer housing to allow a user to rotate the sensor adjustment mechanism to cause the motion detector to move upward and downward. The adjustable motion sensor covered with a fixed window that hides the motion sensor assembly from view.

14 Claims, 15 Drawing Sheets

(56) References Cited

U.S. PATENT DOCUMENTS

| | | | | |
|---|---|---|---|---|
| 2014/0225509 | A1* | 8/2014 | Wiegel et al. | F21V 21/26 315/129 |
| 2015/0092408 | A1* | 4/2015 | Wallach | H05B 37/0227 362/233 |
| 2016/0003461 | A1* | 1/2016 | Chen | F21V 33/00 362/249.02 |

OTHER PUBLICATIONS

Heath Large Area Occupancy Sensor, HC-3600, Heath Commercial, 1994, 2 pages.

* cited by examiner

LIGHT FIXTURE INCLUDING ADJUSTABLE MOTION SENSOR WITH RECTANGULAR COVERAGE PATTERN

CROSS REFERENCE TO RELATED APPLICATIONS

This invention claims the benefit of priority to U.S. Provisional Application Ser. No. 61/945,528 filed on Feb. 27, 2014, the entire disclosure of which is incorporated by reference in its' entirety.

FIELD OF INVENTION

This invention relates to light fixtures, and in particular to systems, devices, and methods for a decorative outdoor light fixture that includes an adjustable motion sensor with a rectangular coverage pattern.

BACKGROUND AND PRIOR ART

Motion sensing controlled lighting and decorative outdoor light fixtures are very popular. Often customers would like to have a product which is decorative, but which also incorporates automatic motion sensing control. A number of problems arise when integrating a motion sensing feature into the light fixture.

From a sensing perspective, the ideal solution is a sensor head which can be readily positioned and aimed so that the sensed coverage area is precisely where it is desired. Unfortunately a movable sensor head is not aesthetically pleasing on a decorative fixture; consequently the desired approach requires a motion sensor that can be concealed within a portion of the light fixture.

In order to achieve a concealed approach, a fixed sensor is often used which can unfortunately result in many compromises in sensor performance. The biggest compromise is that the sensor has no mechanical adjustment and therefore the coverage pattern is fixed. This is ultimately a compromise in terms of the coverage area. Using traditional lens design approaches, the coverage pattern is an approximate fan shape. However, most areas where the coverage is needed such as a yard are not shaped like a fan. As such, it would be more desirable to have a rectangular coverage pattern.

Furthermore, a large problem with a fixed coverage pattern are the false activations that can occur. In a typical application, the house on which the fixture is mounted can be some 40 feet from a street. Although the stated coverage range may typically be 30 feet, under some environmental conditions, such as a passing car that is at a substantially different temperature than the ambient temperature, the sensor may be able to detect the car at ranges far beyond the 30 foot stated range of the sensor. This result can cause undesirable false activation when cars pass by. In short front yards, the street may be readily within the range of the sensing area virtually all of the time, causing continual false activation.

False activations can be reduced by reducing sensitivity in motions sensors that have sensitivity adjustment capability. However, sensitivity adjustments can unfortunately further reduce the sensitivity to motion of people, which may be undesirable.

Thus, the need exists for solutions to the above problems with the prior art. The systems, devices, and methods of the present invention solve some complicated mechanical problems within a small space to deliver a mechanism that allows the internal sensor to be tipped to adjust the pattern of coverage, especially the maximum distance at which it can sense motion, because the sensing beams can be angled to strike the ground thus preventing the coverage pattern from extending beyond the target area.

SUMMARY OF THE INVENTION

A primary objective of the present invention is to provide systems, devices, and methods for an aesthetically decorative light fixture with an adjustable motion detector.

A secondary objective of the present invention is to provide systems, devices, and methods for a light fixture with an adjustable motion detector that tilts an internal sensor upward and downward for changing the pattern of coverage.

A third objective of the present invention is to provide systems, devices, and methods for a light fixture with an adjustable motion detector with coverage that forms a rectangular shaped pattern of coverage.

A fourth objective of the present invention is to provide systems, devices, and methods for a decorative light fixture with internal motion sensor and an external adjustment mechanism.

A first embodiment provides an adjustable motion sensor for a light fixture including a bracket mechanically installable within the light fixture, a movable sensor housing connectable with the bracket, a motion sensor connectable to the movable sensor housing, the motion sensor with an adjustable rectangular coverage area, an adjustment mechanism connected to move the movable sensor housing to adjust a position of the motion sensor housed within the movable sensor housing, and an electronic module in communication with the motion sensor and for supplying an electrical source to the motion sensor and controlling the operation of a lamp in the light fixture.

The bracket can be a C-shaped frame to route electrical wires between the light fixture lamp, the motion sensor and the electronic module and an attachment point for fixedly attaching the movable sensor housing to the C-shaped bracket, and can include at least two rods extending outward from the C-shaped bracket as the structural connection point between the lamp and the light fixture. The at least two rods can be hollow for routing the electrical wires through the hollow rods. The rods can be threaded at one end for mating engagement with a threaded aperture in the C-shaped bracket.

The motion sensor connectable to the movable sensor housing can include a motion detector and a lens with a rectangular coverage area covering the motion detector to direct sensing beams from the motion detector to provide the rectangular coverage area.

The movable sensor housing can include a movable sensor pod that fits within the space formed by the movable sensor housing with the motion sensor connected within the movable sensor pod.

The adjustment mechanism can include a sensor adjustment drive rotatable to apply a force to move the movable sensor pod to adjust the position of the motion sensor housed within the movable sensor pod upward and downward and a head on an exterior end of the sensor adjustment drive accessible for a user to rotate the head to change the position of the motion sensor upward and downward. The adjustment mechanism can include a drive gear coupled with the sensor adjustment drive such that rotation of the sensor adjustment drive causes the movable sensor pod to move and change the direction that the motion sensor is being aimed at.

The electronic module in communication with the movable sensor can supply an electrical source to the motion sensor and can control the operation of a light source in the light fixture.

A second embodiment provides an adjustable motion sensor for a light fixture that includes an outer housing connected to a light fixture frame, a movable sensor assembly including a motion detector contained within the outer housing, a lens covering a portion of the outer housing in the path of the motion detector sensing beams, with the lens directing the sensing beams in a rectangular coverage pattern; and a sensor adjustment mechanism coupled with the movable sensor assembly. The sensor adjustment mechanism can be accessible from an exterior of the outer housing to allow a user to rotate the sensor adjustment mechanism to cause the motion detector to move upward and downward.

The movable sensor assembly can include a bracket mechanically installable within the light fixture frame above or below a lamp socket in the light fixture, the movable sensor assembly inserted into the bracket, a sensor housing assembly within the movable sensor assembly, and a sensor drive mechanism coupled with the movable sensor assembly. The sensor drive mechanism can be accessible from an exterior of the outer housing to allow a user to rotate the sensor drive mechanism to cause the motion detector to move upward and downward.

The bracket can be a C-shaped frame to route electrical wires between the lamp socket, the motion detector and an electronic module and can include an attachment point for fixedly attaching the movable sensor assembly to the C-shaped bracket; and can include at least two rods extending outward from the C-shaped bracket as the structural connection point between the lamp and the light fixture and the rods can be hollow for routing the electrical wires through the hollow rods.

The sensor housing can include a movable sensor pod that fits within the space formed by the sensor housing with the motion detector connected within the movable sensor pod.

The sensor adjustment mechanism can include a sensor adjustment drive shaft rotatable to apply a force to move the movable sensor assembly to adjust a horizontal position of the motion detector housed within the movable sensor assembly upward and downward and a head on an exterior end of the sensor adjustment drive shaft accessible for a user to rotate the head to change the horizontal position of the motion detector upward and downward. The sensor adjustment mechanism can include a drive gear coupled with the sensor adjustment drive such that rotation of the sensor adjustment drive causes the movable sensor assembly to change the direction the motion sensor is aiming, and can include a drive gear on the adjustment drive shaft and a rack gear on the sensor housing.

A third embodiment can include a light fixture with an adjustable motion sensor with a rectangular coverage area that includes a light fixture frame with an outer sensor housing located above or below a light socket within the light fixture frame, a bracket mechanically installable within the outer sensor housing, and a sensor housing connectable with the bracket, a movable motion sensor connectable to the sensor housing, a lens covering a portion of the outer housing in the path of the motion sensor sensing beams, with the lens directing the sensing beams in a rectangular coverage pattern.

A sensor adjustment mechanism can be coupled with the movable motion sensor, the sensor adjustment mechanism can be accessible from an exterior of the outer housing to allow a user to rotate the sensor adjustment mechanism to cause the movable motion sensor to move upward and downward.

The sensor adjustment mechanism can include a sensor adjustment drive shaft rotatable to apply a force to move the movable motion sensor to adjust a position of the motion sensor housed within the sensor housing upward and downward and a head on an exterior end of the sensor adjustment drive shaft accessible for a user to rotate the head to change the position of the motion sensor upward and downward, and an electronic module in communication with the motion sensor and a light socket for supplying an electrical source to the motion sensor and controlling the operation of a lamp in the light fixture lamp socket.

To the knowledge of the inventor, the design and function of the light fixture with an adjustable motion sensor with rectangular coverage pattern of the present invention has not been suggested, anticipated or rendered obvious by any of the prior art references.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
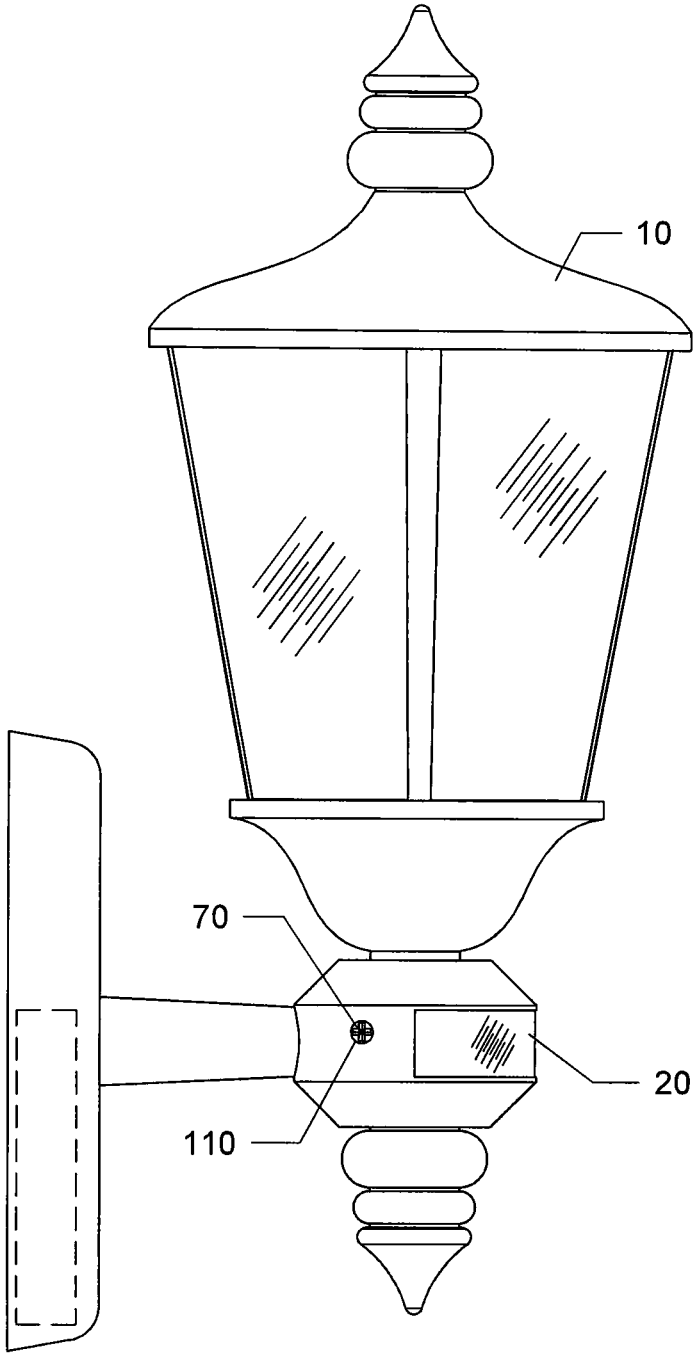
FIG. 1 is a side view of a decorative light fixture showing fixed motion detector window and sensor adjustment drive.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Decorative light fixture
15. Outer housing
20 Fixed window
25 Sensor lens
30 'C" bracket
40 Threaded rod(s)
50 Sensor pod assembly
60 Movable sensor assembly
70 Sensor adjustment drive shaft
80 Drive pinion gear. Part of adjustment drive shaft
90 Fixture wiring
100 Accessory wiring
110 Adjustment drive shaft access hole in light fixture
120 Movable sensor housing
130 Adjustment rack gear. Part of movable sensor housing
140 Sensor housing pivot pin. This pin is captured in the sensor pod and is the axis for the sensor adjustment
150 Pivot axis As stated above, motion sensing controlled lighting and decorative outdoor light fixtures are very popular. Often customers would like to have a product which is decorative, but which also incorporates automatic motion sensing control. A number of problems arise when integrating a motion sensing feature. From a sensing perspective, the ideal solution is a sensor head which can be readily positioned and aimed so that the sensed coverage area is precisely where it is desired. Unfortunately a movable sensor head is not aesthetically pleasing on a decorative fixture; consequently the approach requires a motion sensor that can be concealed within a portion of the light fixture.

The problems associated with motion sensing decorative lights can be solved by providing a hidden motion sensor with an adjustment mechanism that allows the sensor to be pointed downward over a variety of angles from horizontal. The way to achieve this solution is to provide a sensor assembly within sensor housing.

FIG. 1 is a side view of a decorative light fixture 10 showing the fixed optically transparent (at IR wavelengths) window 20 that conceals the internal motion sensor. The outer housing 15 and window 20 is fixed, but the inner sensor includes a means of pivoting the inner sensor so that it can be adjusted upward or more downward facing. The sensor lens 25 is designed with a rectangular coverage pattern instead of the fan-like coverage of the prior art fixtures. The decorative light fixture 10 of the present invention instead extends to provide a rectangular coverage pattern. In addition, the rectangular coverage pattern sensing beams have increased sensitivity that are aimed to provide coverage to the corners of the rectangle.

Fixed window 20 is an optically transparent (at IR wavelengths) window that conceals the internal motion sensor, C-bracket, etc. and also protects the internal structure from rain, snow, wind, etc. Fixed window 20 is attached to the front of sensor pod assembly 50. Sensor pod assembly 50 holds the fixed window 20 against an opening in the front of 15 the lamp fixture housing. The color of fixed window 20 can be matched to the color of the lamp housing and must allow the passage of IR wavelengths with no significant reduction. Alternately, the fixed window 20 could be mounted directly to outer housing 15.

The sensor lens 25 wraps around the front side of movable sensor assembly 60. The sensor lens 25 moves with the movable sensor assembly 60 and can be designed such that the sensor lens 25 creates a rectangular pattern and moves up and down with movable sensor assembly 60.

The decorative light fixture with adjustable motion sensing capability shown in FIG. 1 differs from prior art and achieves a challenging aesthetic requirement, while providing an excellent rectangular coverage pattern that can be adjusted downward from horizontal, while still maintaining a rectangular coverage pattern.

Figure 2:
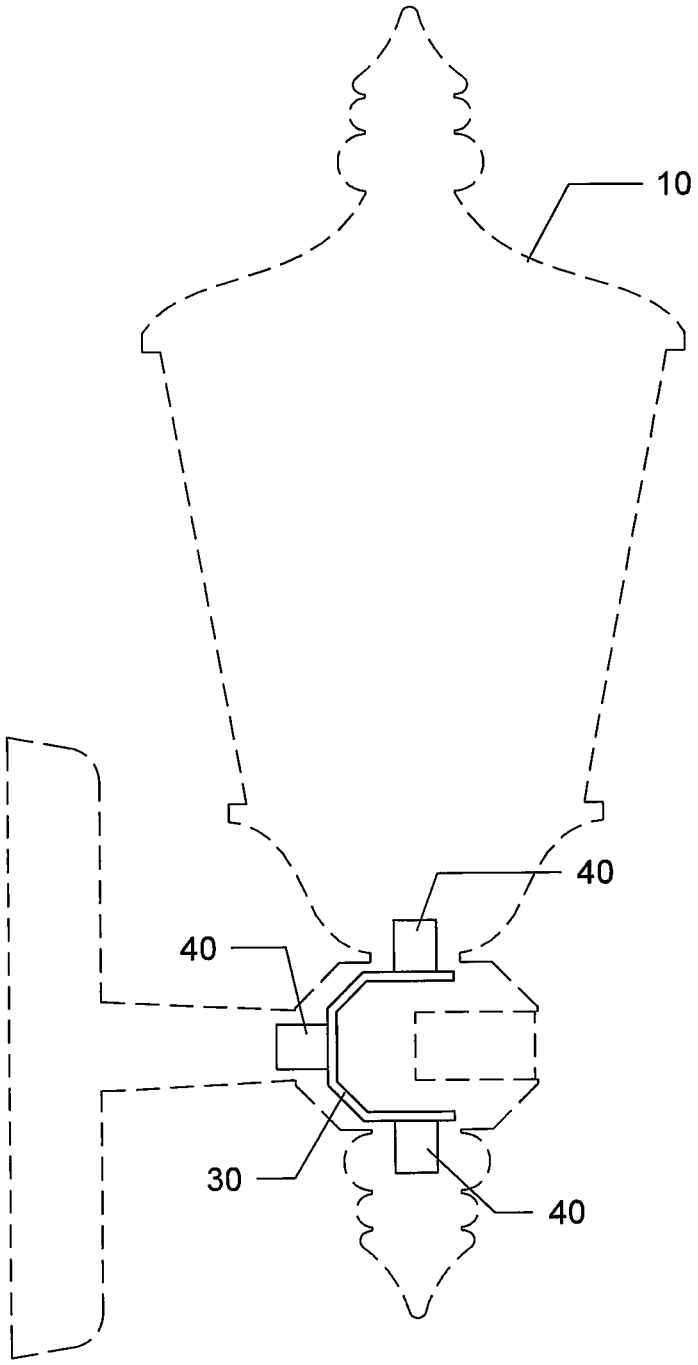
FIG. 2 is a side view (ghosted) of light fixture showing placement of "C" bracket that houses the adjustable sensor pod.

As shown in FIG. 2, the decorative light fixture 10 with adjustable sensing coverage area includes a C-shaped sensor bracket 30 housed within the fixture base outer housing. Housing the adjustable sensing mechanism within the C-shaped bracket 30 solves complicated mechanical problems within a small space by allowing the internal sensor to be tipped to adjust the pattern of coverage. In particular, the sensing beams can be angled to strike the ground within the target area, so it is not possible for coverage to extend beyond the target area.

Figure 3:
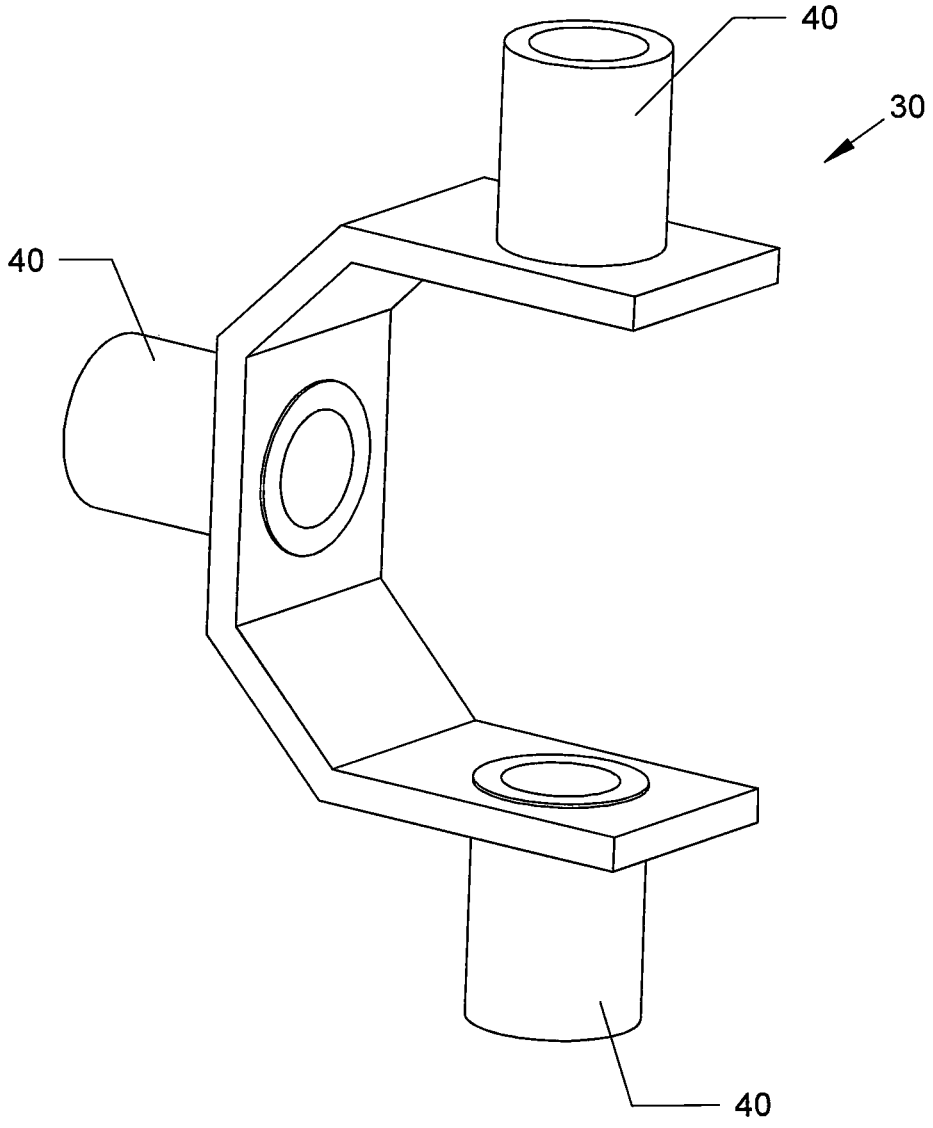
FIG. 3 is a perspective view of "C" bracket used in FIG. 2.
Figure 8:
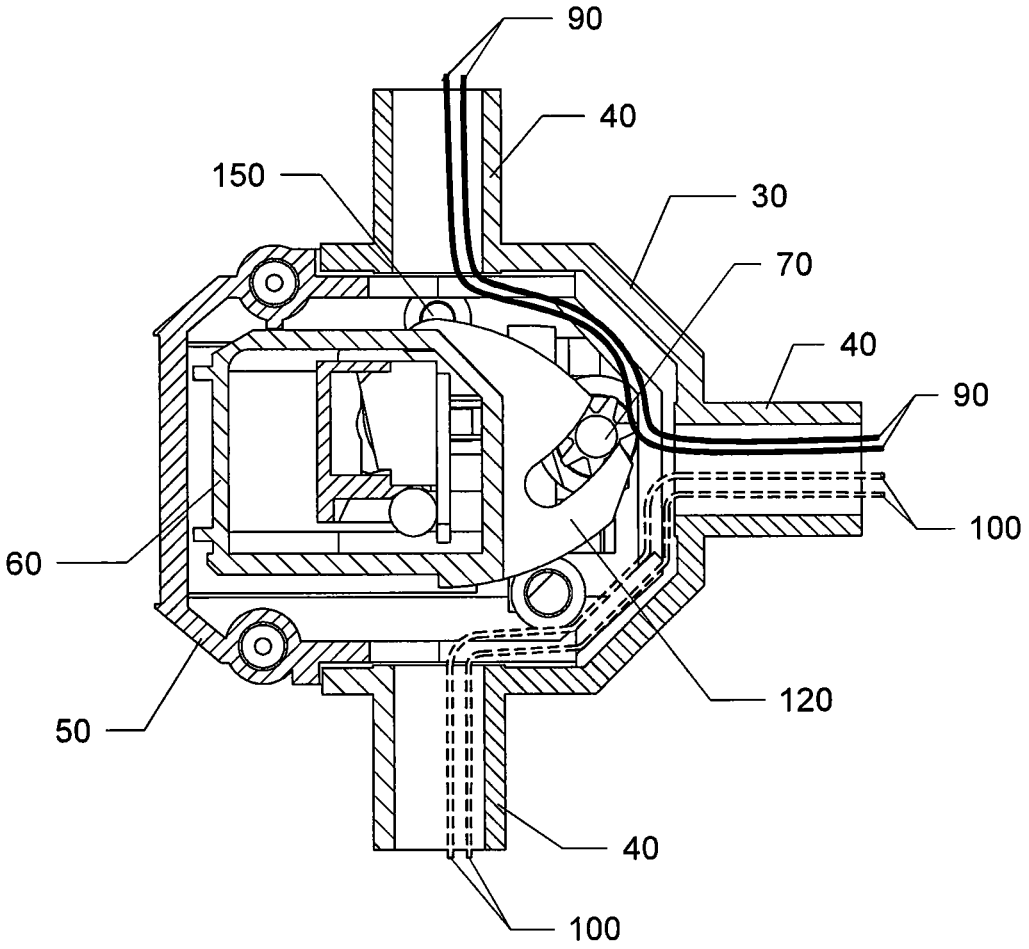
FIG. 8 is a side sectional view of the sensor pod showing the light fixture and accessory wiring.

Referring to FIG. 2 in conjunction with FIG. 1, the decorative light fixture 10 incorporates a motion sensor which is concealed behind the fixed window 20. The motion sensor is contained within a C-shaped bracket 30 which has three threaded rods 40 as shown more clearly in FIG. 3. The threaded rods 40 provide the main structural connection point between the lamp and base of the light fixture 10. The threaded rods 40 are also used as a pathway for routing wires which pass to the light bulb socket and the movable sensor 60 shown in FIG. 4A. As shown in FIGS. 2 and 3, the rods can be hollow rods to allow the light bulb socket wires to pass through the upper rod 40 and be routed to the center rod into the wall mounting structure of the light fixture 10 as shown in FIG. 8. While the rods can be threaded for assembly, the rods can also be press fit into the apertures in the C-shaped bracket.

Figure 4A:
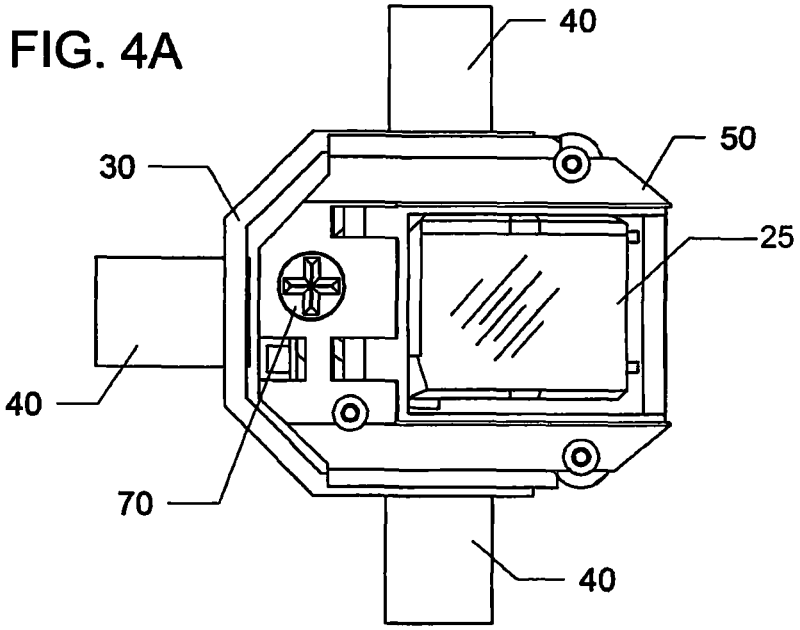
FIG. 4A and FIG. 4B are side views, respectively, of the sensor pod used in the "C" bracket showing the movable sensor adjusted up and down.
Figure 4B:
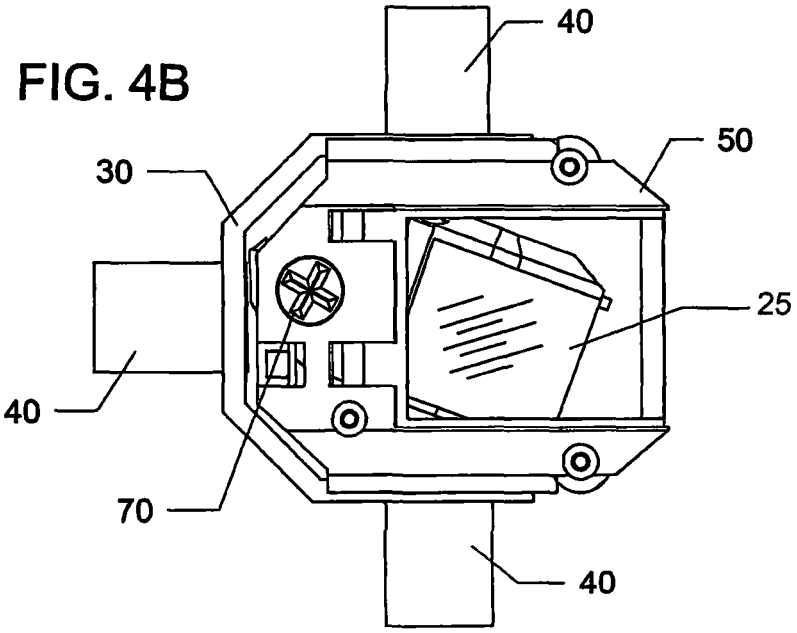

FIGS. 4A and 4B are side views of the sensor pod showing the movable sensor adjusted upward and downward, respectively (fixed window 20 not shown). As shown, the sensor pod 50 fits within the space formed by the C-shaped bracket 30. The sensor pod 50 has several major elements including a movable sensor 60 that engages with the sensor adjustment drive 70. The sensor adjustment drive is rotated to apply forces to move the sensor 60 over a range between the upward direction shown in FIG. 4A and the downward direction shown in FIG. 4B. The movement of the sensor assembly 60 is accomplished using a drive gear 80 coupled with the movable sensor assembly 60 causing the sensor assembly 60 to rotate to adjust the direction the sensor assembly 60 is aiming.

Figure 5:
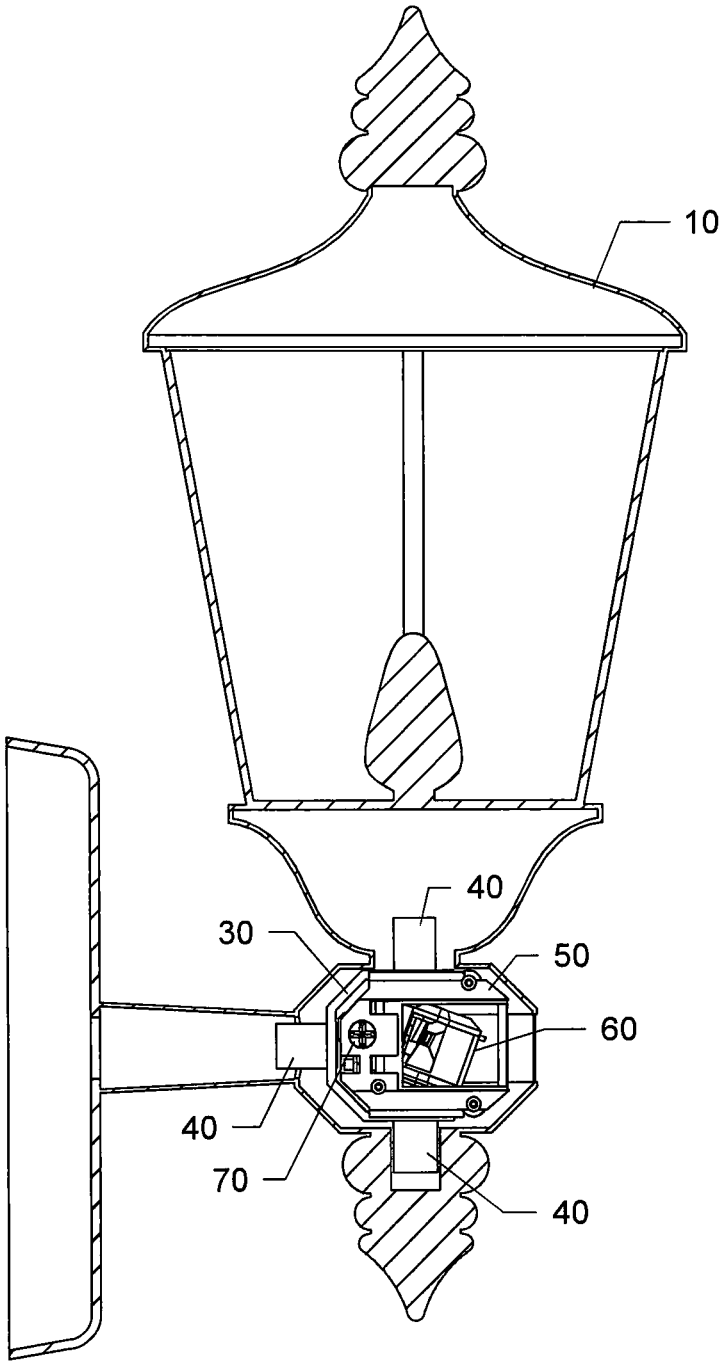
FIG. 5 is a partial sectioned side view of the light fixture showing the sensor pod placement in the "C" bracket.

The sensor pod 50 includes a provision to route fixture wires 90 behind the movable sensor 60. FIG. 5 is a side view of a decorative light fixture 10 showing the placement of the sensor pod 50 within the C-shaped bracket. FIG. 5 also illustrates how the C-shaped bracket 30 and rods 40 hold the sensor pod assembly 50 within the lamp housing. While the decorative light fixture shown has the lamp above the sensing assembly, other light fixture styles have the lamp below the sensor pod 50 without deviating from the scope of the present invention. Depending on the style of the decorative light fixture 10, the lamp can be located above or below the sensor pod 50, and thus follow a second alternate fixture wire 100 path as shown in FIG. 8.

The sensor pod assembly 50 can have a decorative fixed window 20 which is used to conceal a movable sensor assembly 60. The decorative fixed window 20 can be critical to the design, because the hidden internal sensor pod assembly 50 would not be aesthetically pleasing if it were visible. The C-shaped bracket 30 allows the sensor pod assembly 50 to be located in a position with excellent visibility to the desired sensing area in the front and sides of the fixture 10. The internal movable sensor 60 has a pivot point which allows it to tip downward from horizontal over a range of approximately 0 to approximately 25 degrees, which allows substantial control of the forward range of the sensing area.

Figure 6A:
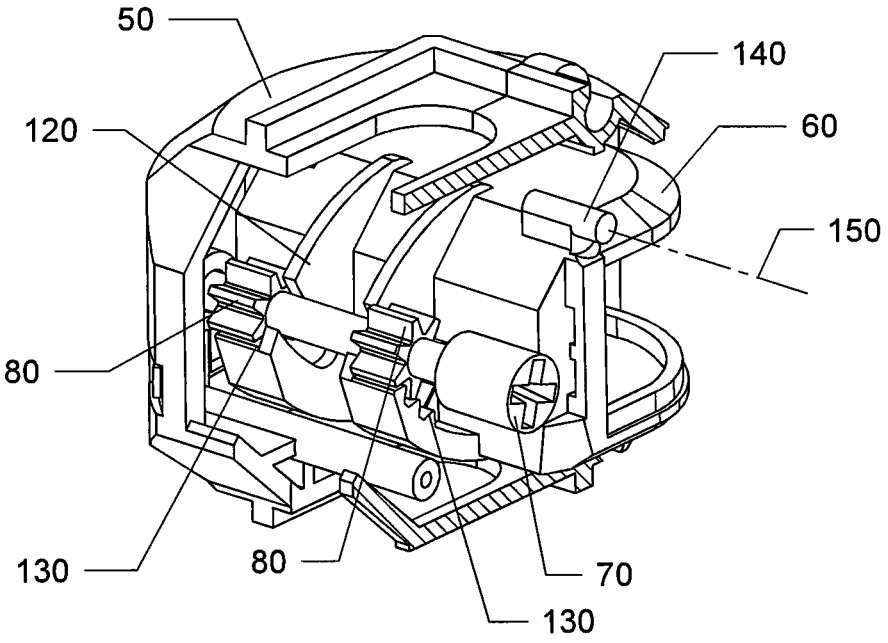
FIG. 6A and FIG. 6B are rear sectioned views, respectively, of the sensor pod of FIG. 4A and FIG. 4B showing the movable sensor adjusted up and down.

FIG. 6A is a rear sectioned view of the sensor pod showing the movable sensor 50 adjusted up (FIG. 6A) and down (FIG. 6B), the fixed window 20 and sensor lens 25 are not shown. The drive gears 80 on the adjustment drive shaft 70 and the rack gears 130 on the sensor housing are visible. The drive mechanism 70 can be operated using a handheld tool, such as a screw driver, and a critical element of the drive mechanism 70 can be a gear drive 80 arrangement that provides rotational motion in the same direction as sensor 50 such that the direction of rotation of the drive shaft 70 is intuitive to the user. FIG. 7A and FIG. 7B are side perspective views of the sensor pod of FIGS. 6A and 6B, respectively, with the movable sensor adjusted up and down.

Figure 6B:
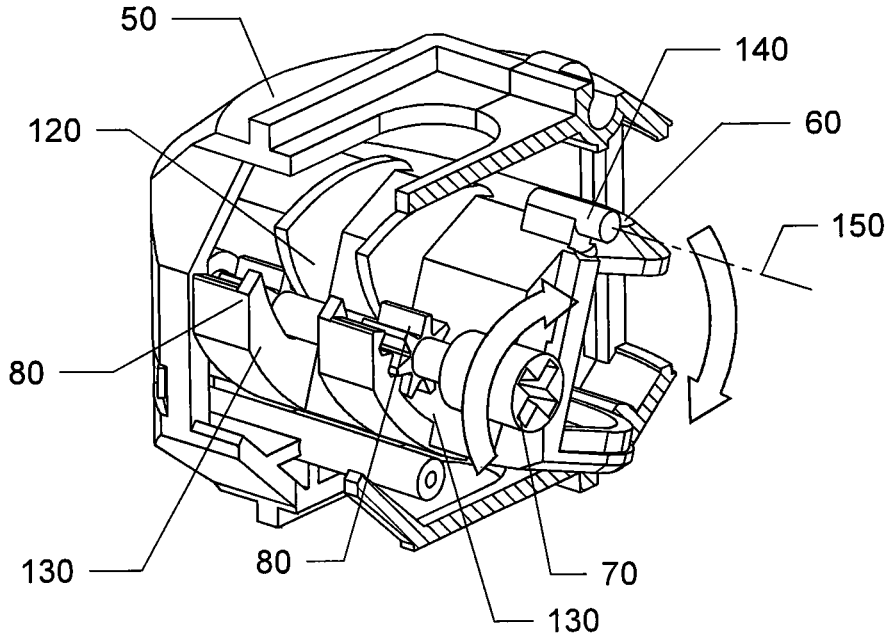
Figure 7A:
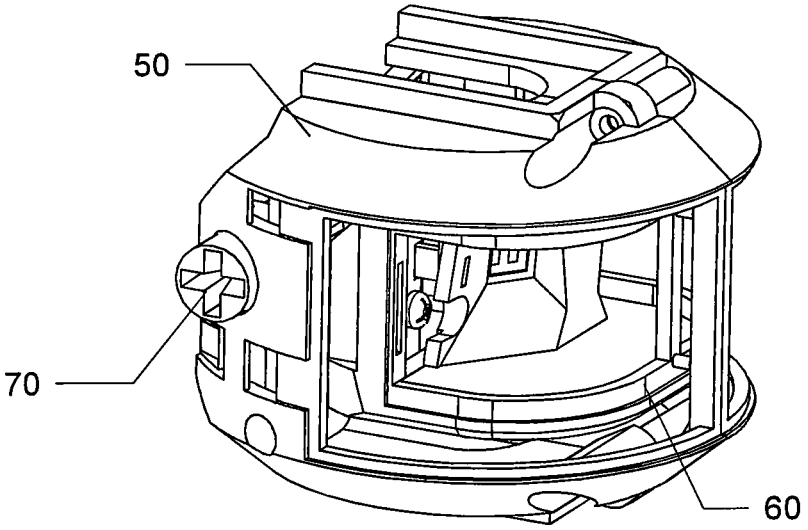
FIG. 7A and FIG. 7B are side perspective views of the sensor pod, respectively, with the movable sensor adjusted up and down.
Figure 7B:
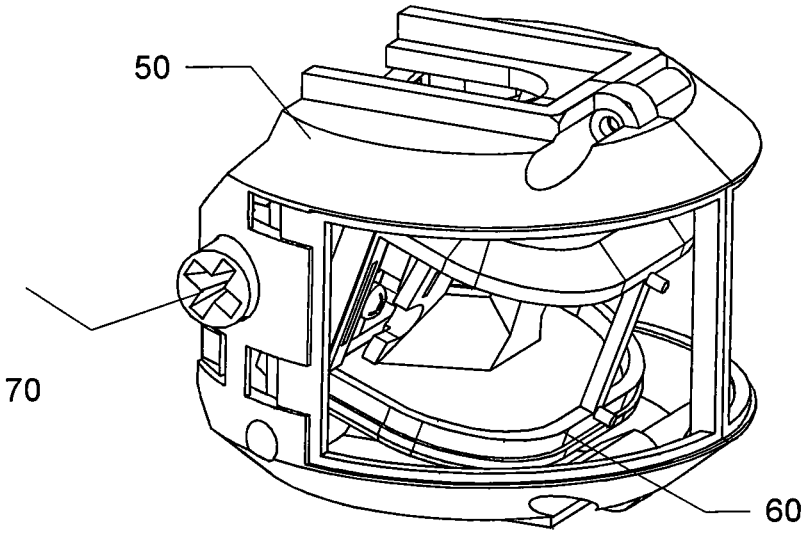

Referring to FIGS. 6A and 6B, as the drive shaft shown in FIG. 6A is rotated clockwise, the sensor assembly 50 rotated in the same direction as shown by the hollow arrows in FIG. 6B. Thus, as the sensor adjustment drive shaft 70 is rotated, the drive pinion gears 80 which is part of the drive shaft are rotated in turn moving the adjustment rack gear 130 that is part of the movable sensor housing 120. The sensor housing pivot pin 140 is captured in the sensor pod and is the axis for the sensor adjustment. To provide space for fixture wires that also pass through the same space, the gear drive mechanism uses two gears 80 which are spaced apart to maximize wire space availability between the two gears 80. The open spaces at the top and bottom of the sensor pod 50 also provide free access for wires to pass through.

The sensor lens 25 (not shown) that covers the movable sensor assembly 60 can be designed to provide a substantially rectangular coverage pattern. However larger heat sources such as passing cars can activate the sensor beyond the normal coverage area for people. The tipping (adjusting) feature allows the movable sensor assembly 60 to be angled downward so that rather than directing sensing beams straight outward, the sensing beams are directed to strike the ground at various distances depending on the level of adjustment.

As a result the sensor mechanism can be adjusted to eliminate false activations by passing cars since the passing cars are no longer within view of the sensing beams.

FIG. 8 is a side sectional view of the sensor pod 50 with the movable sensor 60 adjusted up. As previously described, depending on the light fixture type, the fixture electrical wires 90 can be routed to pass through the upper hollow rod 40 when the lamp is located above the sensor assembly 50 and through the opposite rod 40 when the lamp is located below the sensor assembly 50 as shown by the dashed lines 100.

Still referring to FIG. 8, the assembly sequence of the sensor pod 50 can be very helpful because the fixture can be loosely prewired and the sensor pod 50 can be inserted to push the fixture wires to the back of the C-shaped bracket 30. The sensor pod 50 includes two halves which captures the movable sensor 60 and the sensor adjustment drive 70 as the two halves are screwed together. The outer fixed window 20 on the sensor pod assembly 50 is then attached by sliding the lens tabs through the slots after the case halves are assembled. The threaded rods 40 can have hidden nuts which must be tightened to complete the final assembly of the fixture.

While an example of a sensor drive assembly can be configured for installation and use, those skilled in the art will appreciate that a variety of different configurations can be used to engage the sensor to the sensor adjustment drive. This includes a cam type action which lifts the adjustable sensor up and down. The sensor could also be mounted in a different fashion, not using the C-shaped bracket without deviating from the scope of the invention and still be installed in the area immediately below or above the lamp socket.

The present invention solves some serious problems that have plagued prior art motion sensing decorative lights, mainly adjustability of sensor coverage area. By hiding a movable sensor behind a fixed window, the sensor can be aimed downward to reduce or eliminate spurious false activation by cars on nearby streets while still preserving the aesthetic appearance of the fixture. Because the decorative light fixtures are typically mounted on the front of a home, in a majority of applications, they are pointed directly toward the street with potential sources of false triggering under the right conditions. The ability to point the sensor downward means that the coverage can be set differently based on the distance between the sensor and the street so that it does not direct beams directly into the street.

An advantage in the present invention is to recognize that consumers typically have rectangular spaces in front of the fixture where it is desirable to cover the complete area, not just a fan shape near the sensor. With the adjustable motion sensor of the present invention, there is the ability to reduce the range in front of the motion sensor by aiming the movable sensor assembly downward. However, the range to the far left and right of the motion sensor are not grounded when the moveable sensor assembly is aimed downward and so the range on the sides of the sensor is not reduced as much as the range in the front of the sensor. The original rectangular shape can be retained by reducing sensor sensitivity when the sensor is aimed downward. In this case when the forward looking sensing beams are grounded, the sensitivity can be reduced to bring within the side to side coverage and retain the rectangular pattern.

Figure 9:
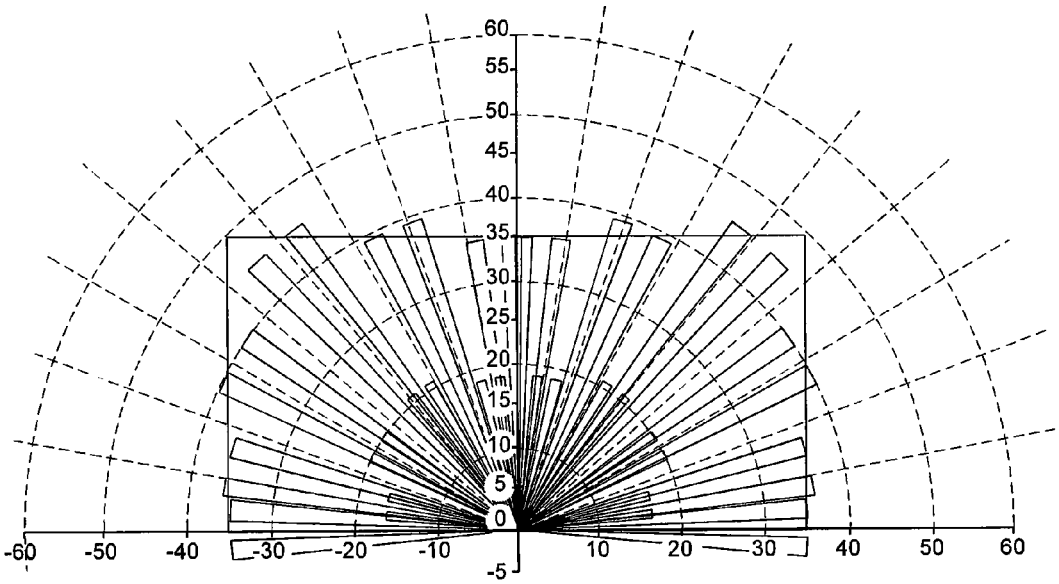
FIG. 9 is a chart showing lens detection for people with maximum sensitivity at maximum elevation.
Figure 10:
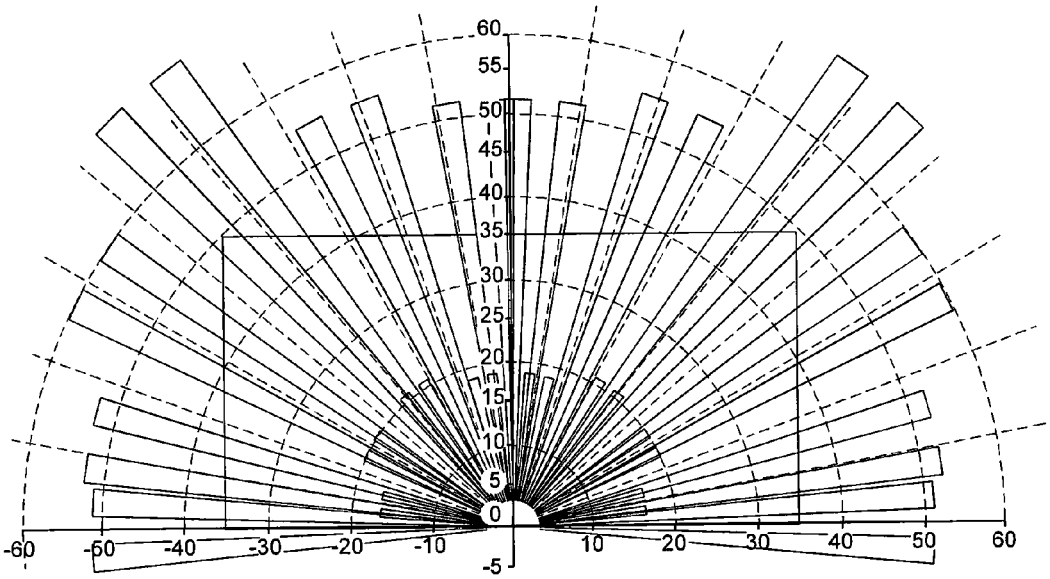
FIG. 10 is a chart showing lens detection for warmer objects at maximum sensitivity and maximum elevation.

The charts shown in FIGS. 9-15 show different sensitivity levels at different sensor elevations and are provided as examples and not limitations of the sensitivity of the sensor assembly. FIG. 9 shows an example of lens detection for people for maximum sensitivity, at maximum elevation. FIG. 10 shows an example of lens detection for warmer objects for maximum sensitivity at maximum elevation. With warmer objects, the detection area in FIG. 10 far exceeds the desired detection area indicated by the rectangle on the chart.

Figure 11:
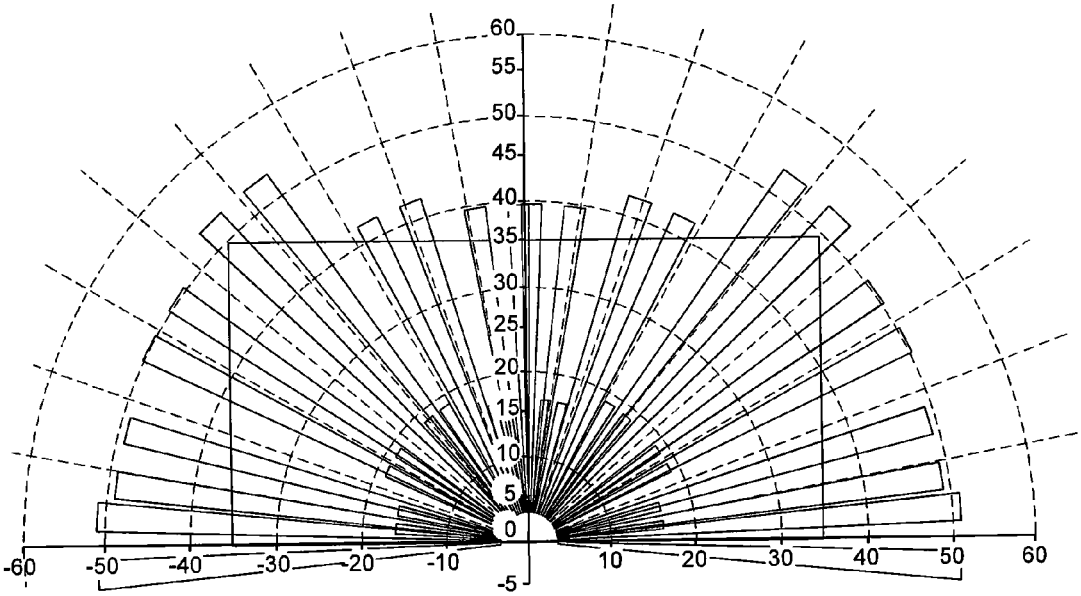
FIG. 11 is a chart showing lens detection for warmer objects at maximum sensitivity and elevation of approximately −3 degrees.
Figure 12:
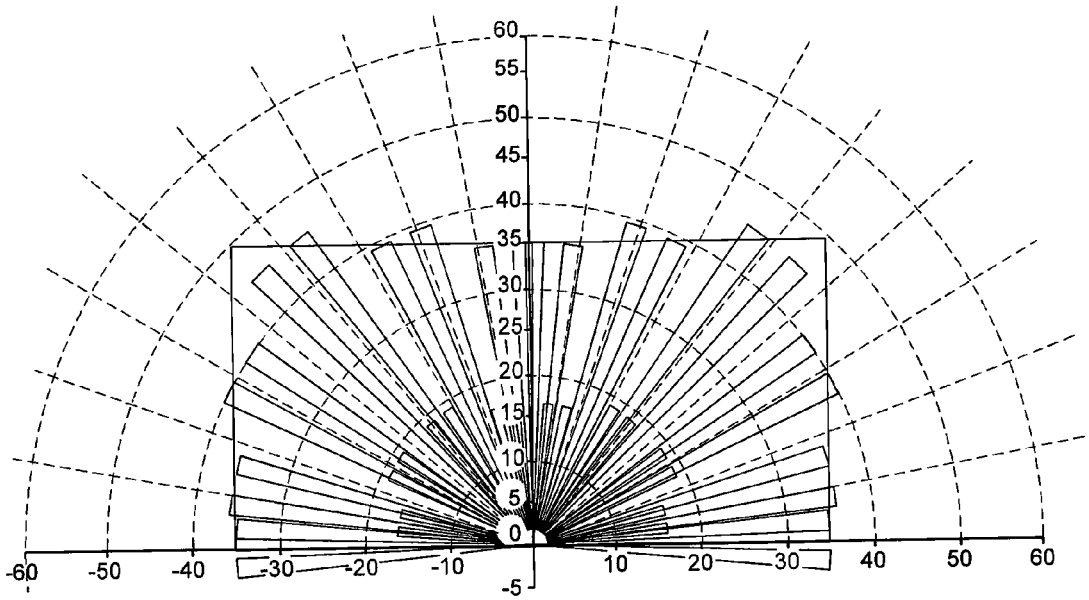
FIG. 12 is a chart showing lens detection for people with maximum sensitivity and an elevation of approximately −3 degrees.

When the elevation of the sensor assembly is adjusted, the detection coverage area changes. FIG. 11 shows an example of the lens detection for warmer objects for maximum sensitivity; for an elevation of approximately −3 degrees while FIG. 12 shows the lens detection for people with maximum sensitivity at an elevation of approximately −3 degrees. While the detection pattern for people maintains the desired rectangular shape, the detection pattern for warmer objects shown in FIG. 11 exceeds the desired range on the left and right sides. If it is desired to reduce the detection range on the left and right sides for warmer objects, reducing the sensitivity of the sensor assembly can also be used to change the sensor coverage area. Since the range of the forward looking sensing beams are limited by hitting the ground rather than sensitivity, the sensitivity can be reduced with little effect on the forward looking sensing beams while significantly reducing the range of the left and right sensing beams.

Figure 13:
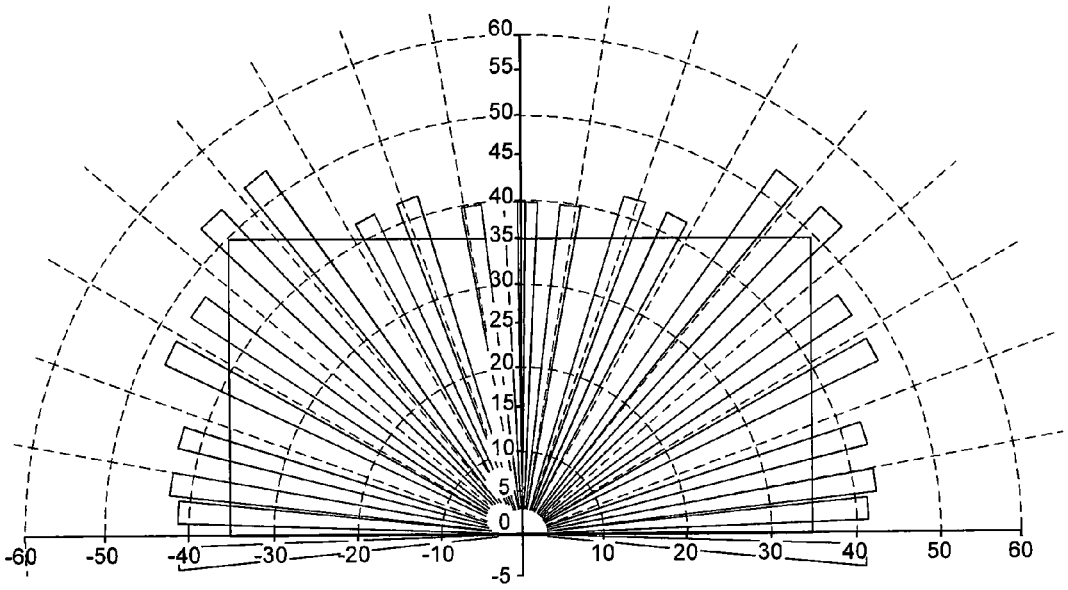
FIG. 13 is a chart showing lens detection for warmer objects with sensitivity of approximately 70% and elevation of −3 degrees.
Figure 14:
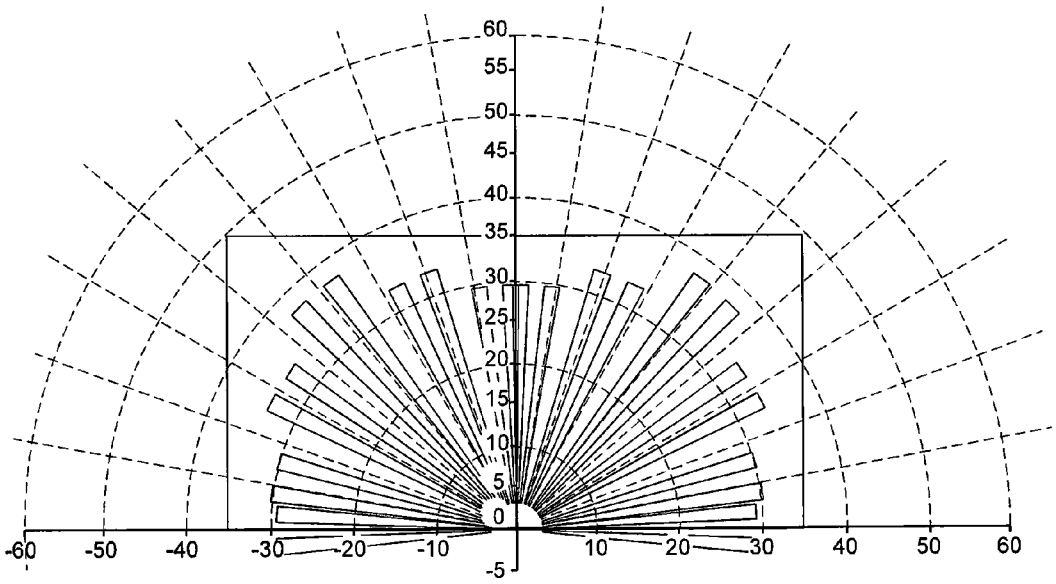
FIG. 14 is a chart showing lens detection for people with sensitivity of approximately 70% and an elevation of approximately −3 degrees.
Figure 15:
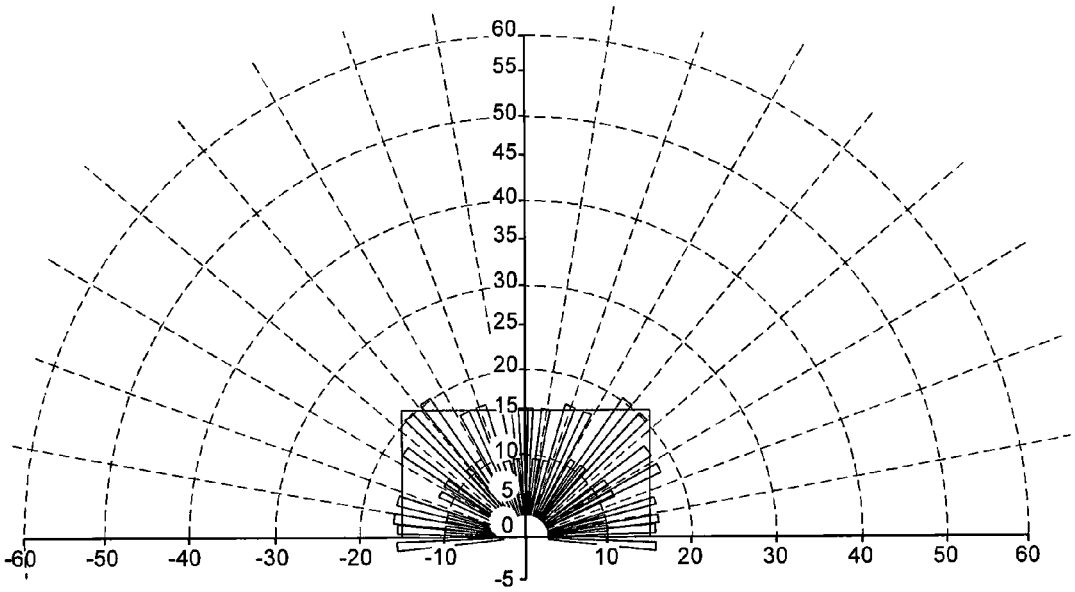
FIG. 15 is a chart showing lens detection for people with sensitivity of approximately 20% and an elevation of approximately −10 degrees.

FIG. 13 shows an example of lens detection for warmer objects with a sensitivity of approximately 70% at an elevation of approximately −3 degrees. When compared to FIG. 11, it can be seen that the range of the left and right sensing beams is reduced with little effect on the forward sensing beams. Likewise, FIG. 14 shows lens detection for people with a sensitivity of approximately 70% and an elevation of approximately −3 degrees. When sensitivity is further reduced to approximately 20%, the coverage area is further reduced as shown in FIG. 15 when the corresponding elevation is approximately −10 degrees.

Those skilled in the art will understand that sensitivity and elevation can be set as precisely as desired, but their effects on range are quite variable. Passive IR motion sensors detect differences in temperature between the background and the object that is moving. This temperature differential and the speed of the object have dramatic effects on range. On a hot summer day when the air temperature is close to skin temperature, range can drop dramatically . . . over 90%. Similarly, if the object is moving very slowly or very fast, range is greatly reduced. Even if testing in a climate controlled environment, it would be difficult to make range measurements that were repeatable within 10%. The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An adjustable motion sensor for a light fixture comprising:

a bracket mechanically installable within the light fixture;

a movable sensor assembly connectable with the bracket and covered with a lens;

a sensor adjustment connected to move the movable sensor assembly to adjust a horizontal position of the movable sensor assembly to change the aim of sensing beams from the motion sensor assembly to adjust the coverage area, the sensor adjustment accessible from an exterior of the light fixture; and an electronic module in communication with the motion sensor for supplying an electrical source to the motion sensor and controlling the operation of a lamp in the light fixture, wherein the bracket includes a C-shaped frame to route electrical wires between the light fixture lamp, the motion sensor and the electronic module, and an attachment point for fixedly attaching the movable sensor assembly to the C-shaped bracket, and at least two rods extending outward from the C-shaped bracket as the structural connection point between the lamp and the light fixture.

2. The adjustable motion sensor of claim 1, wherein the at least two rods are hollow for routing the electrical wires through the hollow rods.

3. The adjustable motion sensor of claim 1, wherein the rods are threaded at one end for mating engagement with threaded aperture in the C-shaped bracket.

4. The adjustable motion sensor of claim 1, wherein the movable sensor assembly comprises:

a motion detector; and a lens with a rectangular coverage area covering the motion detector to direct sensing beams from the motion detector to provide the rectangular coverage area.

5. The adjustable motion sensor of claim 4, wherein the sensor adjustment comprises:

a sensor adjustment drive rotatable to apply a force to move the movable sensor assembly upward and downward; and a head on an exterior end of the sensor adjustment drive accessible for a user to rotate the head to change the position of the motion sensor upward and downward.

6. The adjustable motion sensor of claim 5, wherein the sensor mechanism further comprises:

a drive gear coupled with the sensor adjustment drive such that rotation of the sensor adjustment drive causes the movable sensor assembly to move to change the direction the motion detector is aiming.

7. An adjustable motion sensor for a light fixture comprising:

an outer housing connected to a light fixture frame;

a movable sensor assembly including a motion detector contained within the outer housing;

a lens covering a portion of the movable sensor assembly; and a sensor adjustment coupled with the movable sensor assembly, the sensor adjustment accessible from an exterior of the outer housing to allow a user to adjust the sensor adjustment to cause the motion detector to move upward and downward, wherein the bracket includes a C-shaped bracket to route electrical wires and at least two rods extending outward from the C-shaped bracket as a structural connection point between the light fixture frame and the light fixture.

8. The adjustable motion sensor of claim 7, wherein the movable sensor assembly comprises:

a sensor drive mechanism coupled with the movable sensor assembly, the sensor drive mechanism accessible from an exterior of the outer housing to allow a user to adjust the sensor drive mechanism to cause the motion detector to move upward and downward.

9. The adjustable motion sensor of claim 8, wherein the at least two rods are hollow for routing the electrical wires through the hollow rods.

10. The adjustable motion sensor of claim 8, wherein the sensor adjustment mechanism comprises:

a sensor adjustment drive shaft rotatable to apply a force to move the movable sensor assembly to adjust a horizontal position of the motion detector housed within the movable sensor assembly upward and downward; and a head on an exterior end of the sensor adjustment drive shaft accessible for a user to rotate the head to change the horizontal position of the motion detector upward and downward.

11. The adjustable motion sensor of claim 10, wherein the sensor adjustment mechanism further comprises:

a drive gear coupled with the sensor adjustment drive such that rotation of the sensor adjustment drive causes the movable sensor assembly to change the direction the motion sensor is aiming.

12. The adjustable motion sensor of claim 10, wherein the sensor adjustment mechanism comprises:

a drive gear on the adjustment drive shaft; and a rack gear on the sensor housing.

13. A light fixture with an adjustable motion sensor comprising:

a light fixture frame with an outer housing located above or below a light socket within the light fixture frame;

a C-shaped bracket mechanically installable within the outer housing;

a sensor pod assembly connectable with the bracket;

a movable sensor assembly connectable to the sensor pod assembly;

a fixed window covering a portion of the outer housing in the path of the motion sensor sensing beams:

a sensor adjustment coupled with the movable sensor assembly, the sensor adjustment accessible from an exterior of the outer housing to allow a user to adjust the sensor adjustment to cause the movable motion sensor to move upward and downward; and an electronic module in communication with the motion sensor and light socket for supplying an electrical source to the motion sensor and controlling the operation of a lamp in the light fixture lamp socket, wherein the C-shaped bracket is used to route electrical wires between the light socket, the moveable sensor assembly and the electronic module and at least two rods extending outward from the C-shaped bracket as a structural connection point between the light fixture and the light socket.

14. The adjustable motion sensor of claim 13, wherein the movable sensor assembly has a rectangular coverage area.

* * * * *